United States Patent [19]

Apo

[11] Patent Number: 4,905,995

[45] Date of Patent: Mar. 6, 1990

[54] PORTABLE BASKETBALL ASSEMBLY

[76] Inventor: Samuel U. Apo, 2322 Maile Way, Honolulu, Hi. 96822

[21] Appl. No.: 161,273

[22] Filed: Feb. 22, 1988

Related U.S. Application Data

[63] Continuation-in-part of Ser. No. 912,479, Sep. 29, 1986, abandoned.

[51] Int. Cl.[4] ..... A63B 63/08

[52] U.S. Cl. ..... 273/1.5 R

[58] Field of Search ..... 273/1.5 R, 1.5 A; 210/473–482

[56] References Cited

U.S. PATENT DOCUMENTS

| | | | |
|---|---|---|---|
| 638,698 | 12/1899 | Bourie | 210/473 X |
| 1,544,453 | 3/1925 | Harbison | 273/1.5 R |
| 2,579,312 | 1/1950 | Garvey | 273/1.5 R |
| 2,708,576 | 9/1952 | Verkuilen | 273/1.5 A |
| 3,160,414 | 3/1962 | Gray | 273/1.5 A |
| 3,313,539 | 10/1964 | Michael | 273/1.5 R |
| 3,348,840 | 4/1965 | Dix | 273/1.5 A |
| 3,387,075 | 6/1968 | Wilcox | 210/474 |
| 4,082,269 | 6/1977 | Hill | 273/1.5 R |
| 4,176,588 | 12/1979 | Baron | 210/474 X |
| 4,805,903 | 2/1989 | McArdle | 273/1.5 R |

*Primary Examiner*—Paul E. Shapiro

*Attorney, Agent, or Firm*—Armstrong, Nikaido, Marmelstein, Kubovcik & Murray

[57] ABSTRACT

A basketball net assembly is provided which includes a circular collar having a flanged end to rest on the top inner half of a permanent basketball rim. In a first embodiment, a plurality of holes are equally spaced along the end of the circular collar opposite the flanged end. In a second embodiment a plurality of notches are equally spaced along the lower half to form tables wherein the holes are located above the tabs. In another embodiment, the basketball net assembly is adjustable in size and can include stabilizers. Through the use of the holes and slots, a basketball net is attached to the collar. The present invention provides for the quick and easy installation and removal of a basketball net on a permanent basketball rim.

15 Claims, 8 Drawing Sheets

PORTABLE BASKETBALL ASSEMBLY

This is a continuation-in-part application of Ser. No. 912, 479 filed Sept. 29 1986, now abandoned.

BACKGROUND OF THE INVENTION

1. Field of the Invention

This invention relates to a basketball net assembly and more specifically to a portable basketball net assembly which is easy to mount and dismount on a standard basketball rim.

2. Description of the Prior Art

The basketball net assembly most commonly used today and accepted as the standard in league play, schools, and playgrounds consists of a metal annular ring having an inside diameter of 18 inches. Welded to the underside of the annular ring are twelve metal wire loops. The basketball net is attached to the wire loops by the upper loop strands of the net. The basketball net assembly, including metal annular ring, wire loops and basketball net, are called the goal. The goal is usually permanently attached to a backboard ten feet off the basketball court surface. Most public courts have regulation height goals (ten feet).

Conventional installation of a new or replacement net of the goal is cumbersome since the goal is ten feet off the ground. This means that a ladder is usually necessary to attach a replacement net. Alternate conventional methods for changing a net involved hoisting someone up to the goal or climbing up the goal post, both of which are dangerous.

Outdoor basketball courts which are accessible for public use such as parks, schools, churches, etc., for the most part have goals without nets. The principle reason is due to the height of the goal which requires maintenance personel to have a ladder to replace the nets. In addition, due to heavy use of public courts, the life expectancy of the nets is short (three weeks) and thus it is expensive to frequently replace the net. An additional reason why public courts frequently have goals without nets is due to theft of the net for home use. Thus, public outdoor basketball goals are frequently without basketball nets due to the inconvenience and expense of replacing the net. The lack of nets is in spite of the fact that most basketball players, whether amateurs or skilled professionals prefer to play basketball on courts with nets due to a certain emotion on the part of the basketball player when the player see the net movement from a successful shot. In addition, when a net is provided, there is little dispute as to whether a successful goal has been accomplished while, when a net is not available the ball may pass too quickly through the goal causing a dispute as to whether the ball actually passed through the wire loop.

Finally, installation of nets on goals is not only inconvenient due to the requirement for a ladder, it is also time consuming since each upper loop of the net must be individually manipulatively attached to net supporting hooks on the metal annular rim. Thus, the net must be attached to twelve supporting hooks by manipulating the twelve upper most net loops through the spiral looped hooks.

An attachable basketball goal described in U.S. Patent No. 1,544,453 describes an attachable frame having the same diameter as the permanent rim. The frame is provided, at predetermined intervals, with apertures through which the lower ends of small springs are passed. The upper ends of the springs are made in the form of a hook or a loop which is passed around the permanent basketball rim. Thus, a ladder is necessary in order to attach the basketball goal frame to the permanent basketball rim. In addition, a ladder or alternate method is needed in order to change the basketball net since the net is not easily installed on the frame.

The portable basketball net assembly of the present invention is designed to overcome the aforementioned problems. In addition, the present invention allows individuals to play basketball with a netted goal at all times since the invention is portable and easy to mount and dismount on a standard basketball rim.

SUMMARY OF THE INVENTION

The object of this invention is to provide a portable basketball net assembly that is easily mounted or dismounted on a standard basketball rim from ground level.

It is another object of this invention to allow the installation and removal of the basketball net assembly from a rim without the use of a ladder of similar device to elevate the user up to the rim.

An additional object of the invention is to provide a basketball net assembly that does not interfere with the basketballs action in the permanent rim.

It is an additional object of the present invention to provide a basketball net assembly which is constructed in one piece without any moving parts.

It is still another object of the invention to provide a basketball net assembly which is maintenance free except for the occasional replacement of the basketball net.

Finally, it is an object of the invention to have a basketball net assembly that is portable and easy to use.

The portable basketball net assembly of the present invention comprises an annular collar having a flange at its top edge. The dimensions of the annular collar are such that it will fit inside a standard basketball rim. The top flange allows the collar to rest on the standard basketball rim. A plurality of net engaging means, in particular twelve, are equally spaced on the lower half of the annular collar. The basketball net top loops are attached to the plastic collar by attching the loop ends of the net to the net engaging means.

In a first embodiment, the net engaging means are holes in the collar and the net is tied in the holes. In a second embodiment of the present invention the net engaging means comprises two slots equally spaced below each of the plurality of holes on the lower half of the annular collar. The basketball net top loops are attached to the annular collar by slipping each net loop through one of the holes and securing the loop around the slot provided by the two slots at the collars edge.

Through the design of the present invention, the annular collar is nested within the permanent basketball rim and is supported there by a flange resting on the rim. This design provides for quick and easy net installation and removal. In addition, due to the dimensions of the annular collar with the flange, the collar remains stable when placed inside permanent rim and functions as if it were directly attached to the rim.

These and other objects and advantages will be discussed in more detail hereinafter with reference to the following drawings:

BRIEF DESCRIPTION OF THE DRAWINGS

Referring to the accompanying drawings, which are for illustration purposes only.

DETAILED DESCRIPTION OF THE PREFERRED EMBODIMENTS

Figure 1:
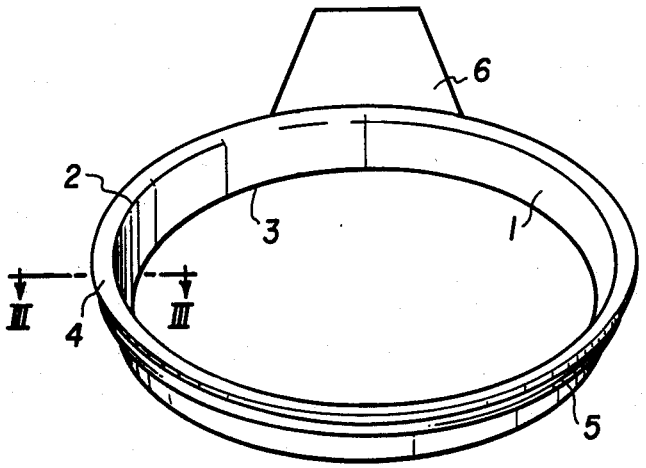
FIG. 1 is a perspective view of a first embodiment of the present invention.

FIG. 1 shows the portable basketball net assembly of the present invention. The portable basketball net assembly consists of an annular collar 1 having a top edge 2 and a bottom edge 3. A flange 4 is formed at the top edge 2 of the collar 1.

The annular collar 1 and its flange portion 4 are formed out of a molded plastic. However, any material can be used that is light weight and stiff enough to function properly.

Figure 3:
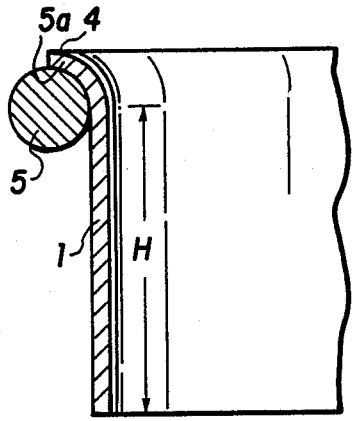
FIG. 3 is a partial sectional view along line III—III in FIG. 1.

FIG. 3 is a cross-sectional view of the annular collar and flange. As shown in FIG. 3, the height H of the collar portion 1 is approximately two inches. The flange portion 4 of the collar rests on the top inner half 5*a* of the permanent basketball rim 5 which is attached to a backboard (not shown) by backboard bracket 6. The collar and flange are fitted into the interior part of the basketball rim 5 abutting the interior part of the rim. Through the use of the collar and flange, the portable basketball assembly is stabilized on the permanent basketball rim 5.

Figure 2:
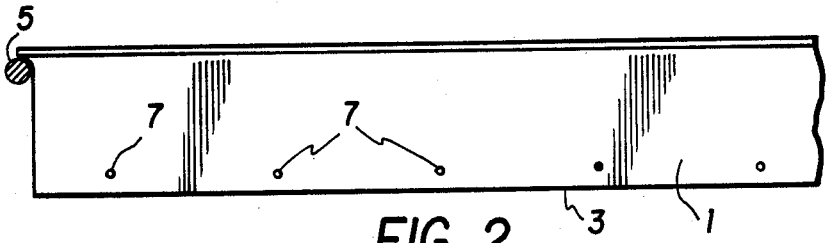
FIG. 2 is a partial side sectional view of the net assembly and rim of the present invention.

FIG. 2 shown a sectional side view of the collar and flange inserted into the permanent ring 5. A plurality of holes 7 are equally spaced near the bottom edge 3 of the collar. A basketball net is attached to the collar through these holes.

Figure 4:
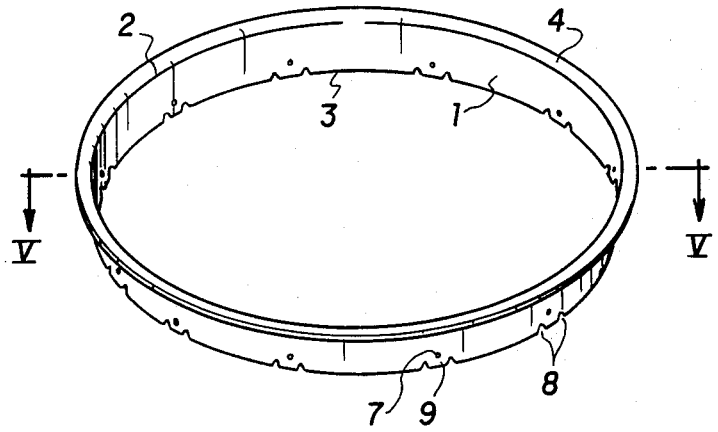
FIG. 4 is a perspective view of a second embodiment of the present invention.
Figure 5:
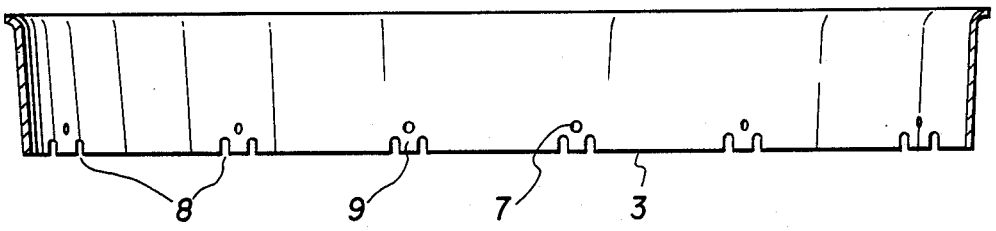
FIG. 5 is a sectional view along the V—V in FIG. 4.

FIGS. 4 and 5, in which like reference numerals referred to similar parts, show a second embodiment of the present invention. In this embodiment, a pair of notches 8 are formed in the lower edge 3 of the collar 1. The notches 8 are formed below the holes 7 and are equally spaced on either side of the hole 7 forming a tab 9. Although the tab 9 is shown rectangular in form, any shape, such as triangular or the like, can be used. In this embodiment, the holes 7, notches 8 and tab 9 are used as a means for holding basketball net.

Figures 6A, 6B, 6C:
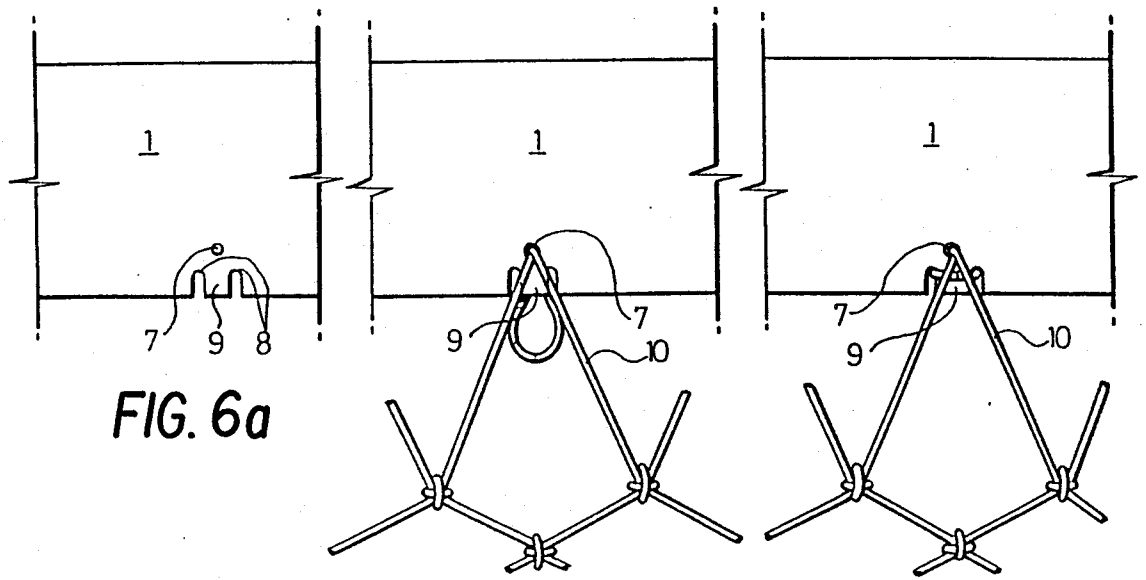
FIGS. 6*a*–6*c* illustrates from the inside how the net is attached to the collar in the second embodiment of the present invention.

FIGS. 6*a*–6*c* illustrates the manner in which a basketball net is attached to the basketball assembly as seen from the inside of the collar 1 of the second embodiment.

FIG. 6*a* show the hole 7, notches 8 and tab 9 of the collar 1 without the net. FIG. 6*b* shows a net 10 being inserted into hole 7. FIG. 6*c* shows the net 10 attached to the basketball net assembly by looping the end of the net 10 between the notches 8 and placing it around the tab 9.

Figures 7A, 7B, 7C:
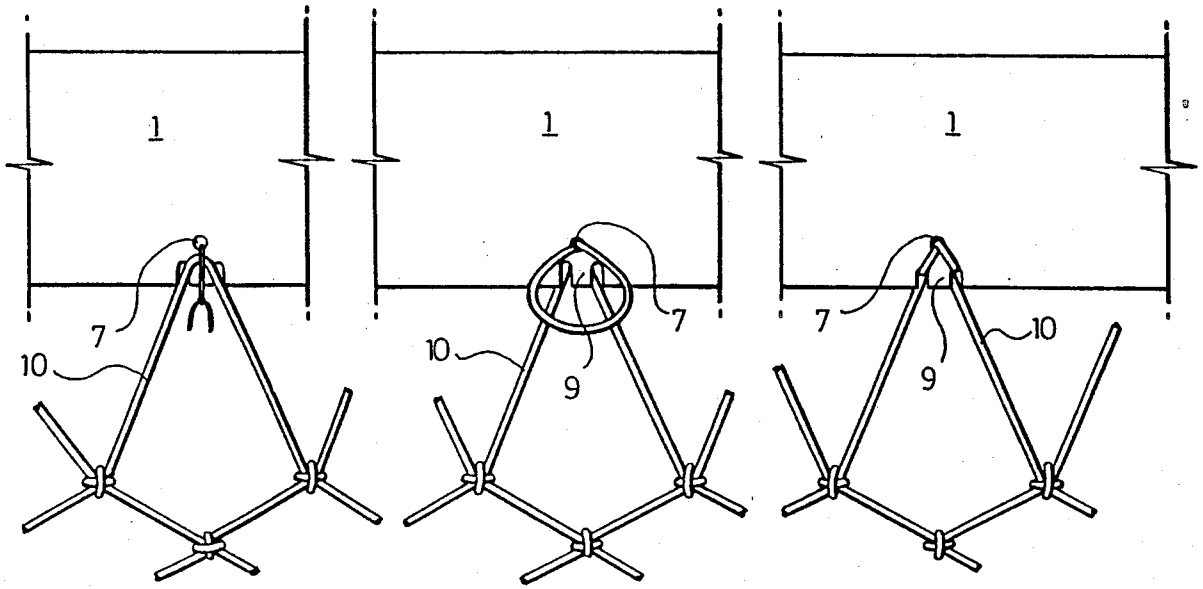
FIGS. 7*a*–7*c* are side views of the second embodiment from outside the collar illustrating two ways to attach the net.

FIGS. 7*a*–7*c* shows the net 10 attached to the basketball assembly from outside the collar. FIG. 7*a* shows the basketball net 10 beig inserted through hole 7 from the inside of the collar and projecting out of the outside of the collar. FIG. 7*b* shows the basketball net 10 attached to the collar. FIG. 7*c* shows an additional way of attaching the net 10 by tying it to the collar 1 of the basketball net assembly. The method shown in FIG. 7*c* can also be used in the first embodiment to attach the net 10 to collar 1.

Figure 8A:
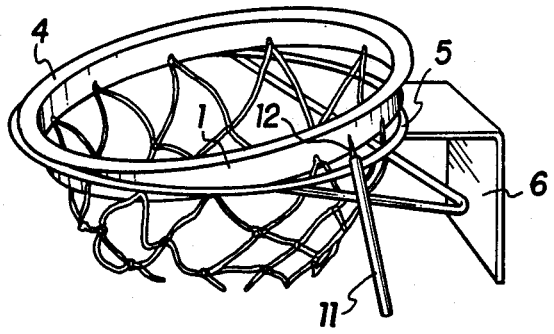
FIGS. 8*a*–8*b* illustrates the present invention being inserted into the permanent basketball rim.
Figure 8C:
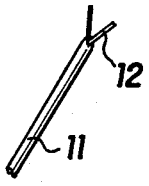
FIG. 8*c* illustrates a means of inserting the collar.
Figure 8B:
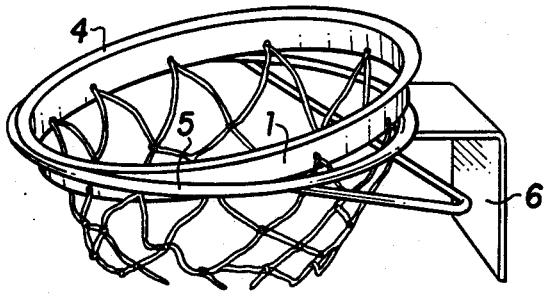

FIG. 8*a* shows the collar 1 being inserted into the basketball rim 5 attached to the backboard bracket 6. As shown in FIG. 8*a*, the basketball net assembly rests on the permanent basketball rim 5 through the flange 4 resting on the top inner half of the permanent rim. FIG. 8*b* shows the basketball net assembly being inserted into the basketball permanent rim 5 through the use of a placement device consisting of a long pole 11, such as a wooden stick or the like. Attached to the end of the pole 11 is a pair of projecting pins 12 projecting out of one end of the pole 11 shown in FIG. 8*c*. As shown in FIG. 8*b*, the collar 1 is inserted between the pair of pins 12 and hoisted up to the basketball permanent rim in order to be inserted. Thus, the basketball net assembly can be easily installed into a permanent rim without using a ladder since the flange of the basketball net assembly rests on the permanent rim and is not attached to the permanent rim.

Figure 9:
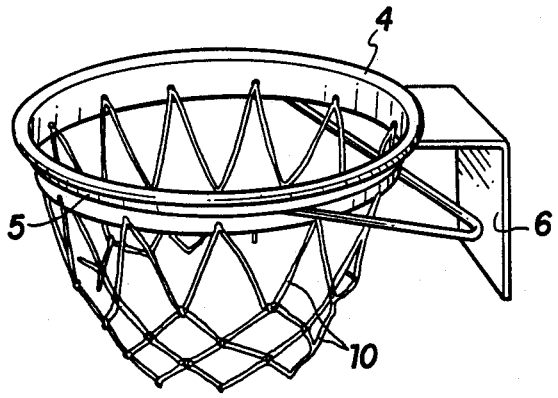
FIG. 9 shows the present invention in place under a permanent basketball rim.

FIG. 9 shows the basketball net assembly completely mounted inside the permanent basketball rim 9. As shown in FIG. 9, the collar fits inside the permanent rim 5 while the flange rests on the top inner half of the permanent rim.

Figure 10:
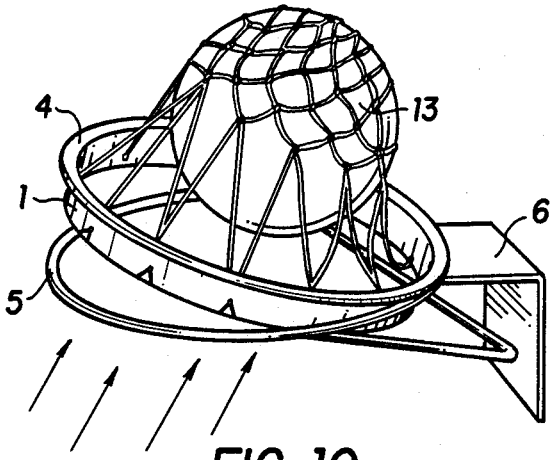
FIG. 10 illustrates a method of removing the present invention from the permanent rim with a basketball.

FIG. 10 illustrates the removal of the basketball net assembly from the permanent rim 5. A basketball 13 is tosses from underneath the rim into the net hanging beneath the collar. The force of the basketball being thrown through the net upwardly lifts the entire assembly off the permanent rim, which will then fall to the ground. Thus, the invention is easy to dismount from a standard rim without having to position oneself at the ten foot height of the basketball permanent rim.

The present invention can be modified as shown in FIGS. 11–16 to be adjustable. Although a regulation basketball goal has an 18" diameter rim, a non-regulation basketball goal may be smaller or larger. Therefore, an adjustable portable basketball device is necessary in order to be used with non-regulation basketball goals.

Figure 12:
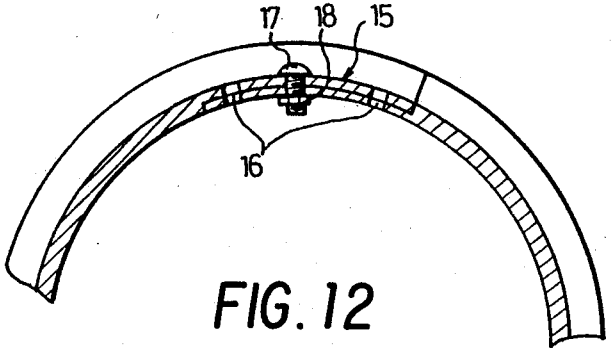
FIG. 12 shows a bottom cross-sectional view of the adjustable collar with a fixing means.
Figure 13:
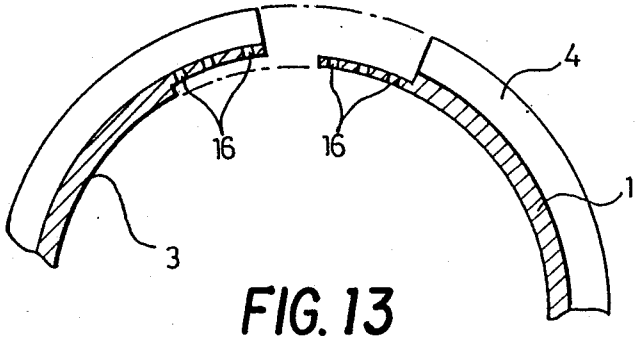
FIG. 13 shows an additional bottom cross-sectional view of the adjustable collar of FIG. 12.
Figure 11:
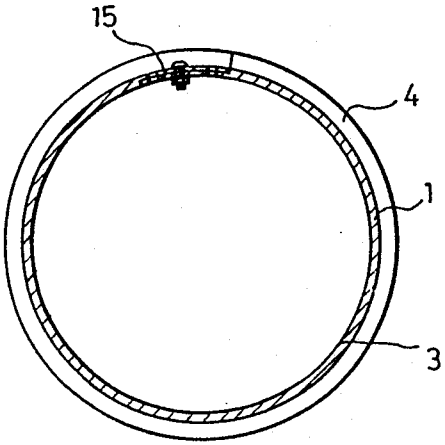
FIG. 11 illustrates an additional embodiment of the present invention which shows a bottom view of an adjustable collar.

One example of an adjustable basketball net assembly is shown in FIGS. 11–13. The adjustable basketball net assembly contains an adjustable means 15. As shown in FIG. 12 and FIG. 13, the adjustable means comprises a plurality of holes 16 in the collar 1 of the basketball net assembly. An attaching means such as a bolt or screw 17 and a washer 18 are used to adjust the size of the collar.

Figure 15:
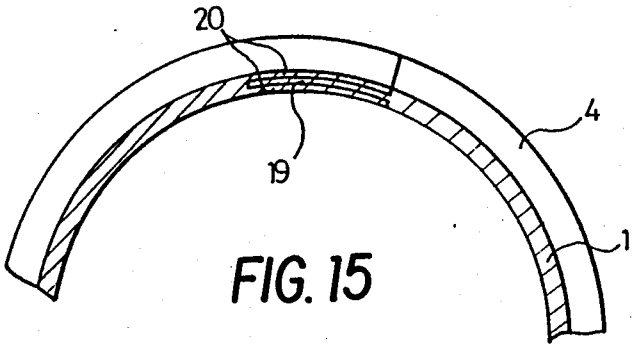
FIG. 15 shows a bottom cross-sectional view of the mortise and tenon system in FIG. 14.
Figure 16:
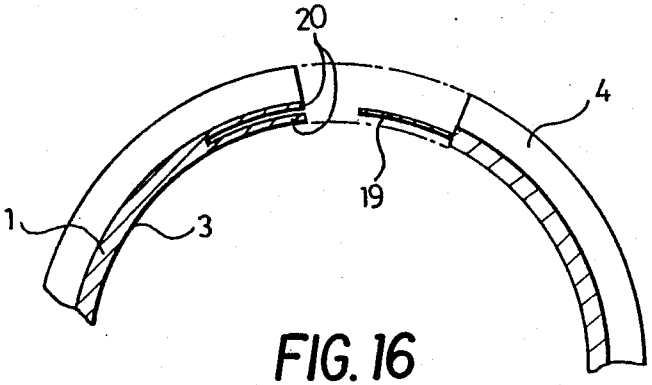
FIG. 16 shows a bottom cross-sectional view of the separated mortise and tenon of the adjustable collar in FIG. 15.
Figure 14:
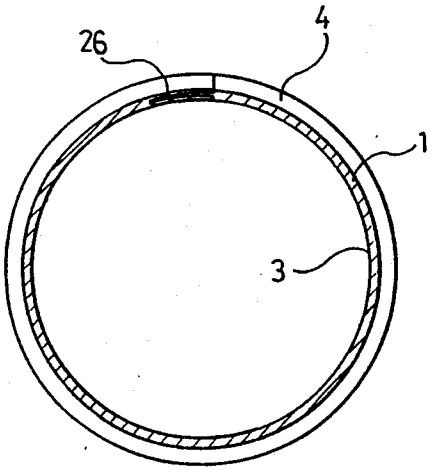
FIG. 14 shows a bottom view of a second adjustable collar using a mortise and tenon system.

An additional way to form an adjustable basketball net assembly is shown in FIGS. 14–16 containing an adjusting means 26. As shown in FIGS. 15 and 16, the adjusting means comprises a mortise 20 with a tenon 19. In addition, although not shown in the figures, the mortise and tenon can also be secured to one another using a fixing means such as a bolt and washer. Although a bolt and washer are shown in FIGS. 11–13, additional fixing means can be used such as a clamp, screw, clip, etc.

Figure 17:
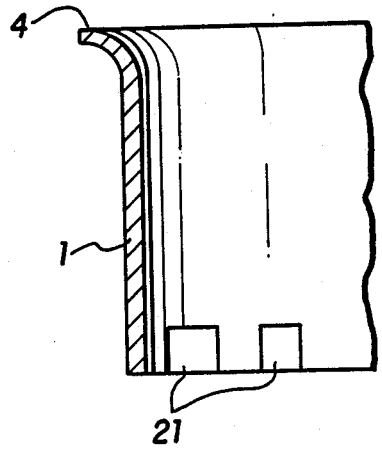
FIG. 17 shows an additional embodiment to the present invention containing an adaptor such as a stabilizer.

FIG. 17 shows another embodiment of the present invention in which one or a plurality of stabilizers 21 are attached to the collar 1. The stabilizers or adapters are either made an integral part of the collar or can be attached anywhere on the collar or flange in order to stabilize the basketball net assembly on the rim.

Through the use of the collar 1, the flange 4, and the holes 7, the present invention provides a truly portable basketball net assembly which can be easily mounted or dismounted from a standard basketball rim from ground level.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. A circular basketball net support, said circular basketball net support comprising:

cylindrical collar means having first and second ends;

a circular flange means attached to said first end of said cylindrical collar means for abutment on a basketball rim; and attaching means affixed to said cylindrical collar means for attaching a basketball net to said cylindrical collar means.

2. A circular basketball net support according to claim 1, wherein said cylindrical collar means and said circular flange means are made of a flexible plastic material.

3. A circular basketball net support according to claim 1, wherein said circular flange means and said cylindrical collar means are integrally formed.

4. A circular basketball net support according to claim 1, wherein said attaching means for attaching said basketball net are a plurality of equally spaced holes in said cylindrical collar means positioned around a perimeter of said second end of said cylindrical collar means.

5. A circular basketball net support according to claim 4, wherein said attaching means further includes a pair of slots equally spaced about each of said equally spaced holes and a tab formed between each of said slots.

6. A circular basketball net support according to claim 4, wherein the number of said equally spaced holes is 12.

7. A circular basketball net support according to claim 1, wherein an inside diameter of said cylindrical collar means is 17 $\frac{5}{8}$ inches.

8. A circular basketball net support according to claim 1, wherein said cylindrical collar means and said attaching means are integrally formed.

9. A circular basketball net support according to claim 1, wherein said cylindrical collar means, circular flange means and attaching means are integrally formed.

10. A circular basketball net support according to claim 1, wherein said cylindrical collar means includes an adjusting means for adjusting a diameter of said circular flange means and said cylindrical collar means.

11. A circular basketball net support according to claim 10, wherein said adjusting means includes a plurality of holes formed in said cylindrical collar means and a connecting means for adjustably connecting together at least two of said holes.

12. A circular basketball net support according to claim 11, wherein said connecting means comprises at least one screw and one nut.

13. A circular basketball net support according to claim 10, wherein said adjusting means is a mortise and tenon.

14. A circular net support comprising:

circular collar means having first and second ends;

a circular flange means attached to said first end of said circular collar means for abutment on a basketball rim; and attaching means affixed to said circular collar means for attaching a net to said circular collar means, said attaching means being a plurality of equally spaced holes in said circular collar means positioned around a perimeter of said second end of said circular collar means, said attaching means further including a pair of slots equally spaced about each of said equally spaced holes.

15. A circular net support comprising:

a cylindrical collar means having first and second ends;

a circular flange means attached to said first end of said cylindrical collar means for abutment on a permanent basketball rim of a regulation basketball goal, said circular flange means extending to an extent which would coincide with a top inner periphery of said permanent basketball rim when in abutment; and attaching means affixed to said cylindrical collar means for attaching a net to said cylindrical collar means.

* * * * *